US011229242B2

(12) United States Patent
Breitwieser et al.

(10) Patent No.: US 11,229,242 B2
(45) Date of Patent: Jan. 25, 2022

(54) ADJUSTABLE BREAST SUPPORT GARMENT

(71) Applicant: LULULEMON ATHLETICA CANADA INC., Vancouver (CA)

(72) Inventors: Julia Mary Breitwieser, Vancouver (CA); Rebecca Glazier, New Westminster (CA); Lyne Marie Alice Deshaies Glanzmann, Vancouver (CA); Elena Palchevsky, Maple Ridge (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 156 days.

(21) Appl. No.: 16/786,904

(22) Filed: Feb. 10, 2020

(65) Prior Publication Data

US 2020/0288791 A1 Sep. 17, 2020

Related U.S. Application Data

(60) Provisional application No. 62/818,721, filed on Mar. 14, 2019.

(51) Int. Cl.
*A41C 3/00* (2006.01)

(52) U.S. Cl.
CPC ..... *A41C 3/0028* (2013.01); *A41C 3/0021* (2013.01)

(58) Field of Classification Search
CPC ..... A41C 3/0021; A41C 3/0028
USPC ..... 450/86
See application file for complete search history.

(56) References Cited

U.S. PATENT DOCUMENTS 2,374,093 A * 4/1945 Gluckin ..... A41C 3/0021 450/59
2,421,448 A * 6/1947 Witkower ..... A41C 3/0021 450/63
2,427,402 A * 9/1947 Gluckin ..... A41C 3/0021 450/59
2,438,210 A * 3/1948 Gluckin ..... A41C 3/0021 450/59
2,488,105 A * 11/1949 Weil ..... A41C 3/0028 450/68
2,543,984 A * 3/1951 Panes ..... A41C 3/0028 450/63
3,306,299 A * 2/1967 Paramore ..... A41C 3/0007 450/81
5,652,960 A * 8/1997 Kaknevicius ..... A41D 1/215 2/104

(Continued)

*Primary Examiner* — Gloria M Hale
(74) *Attorney, Agent, or Firm* — Conneely PC; Joseph Conneely

(57) ABSTRACT

This invention relates to an adjustable breast support garment that can adjust the size and the amount of breast support to preferred fit and sensation (more supported or less) from a single point using a single tensioning system that is easy reachable by the wearer. The adjustable breast support garment of the invention is configured to adjust the tension over the shoulders, around the chest, and in some implementations around the under-arm openings and neckline from a single point using a system of channels integrated into the garment. Elastic straps, webbings, shock cords or any combination thereof can be inserted and run through the system of channels in order to provide a tension change when pulled from a single point.

14 Claims, 7 Drawing Sheets

(56) References Cited

U.S. PATENT DOCUMENTS

| | | | | |
|---|---|---|---|---|
| 6,280,287 | B1 * | 8/2001 | Keith | A41C 3/0028 450/1 |
| 7,267,599 | B2 * | 9/2007 | Allen | A41C 3/0028 450/67 |
| 7,938,710 | B2 * | 5/2011 | Silverman | A41C 3/0021 450/67 |
| 8,506,350 | B1 * | 8/2013 | Silverman | A41C 3/0021 450/67 |
| 9,226,530 | B1 * | 1/2016 | Silverman | A41C 3/0021 |
| 2010/0022165 | A1 * | 1/2010 | Silverman | A41C 3/0021 450/65 |
| 2011/0081827 | A1 * | 4/2011 | Williams | A41C 3/0021 450/65 |
| 2016/0227847 | A1 * | 8/2016 | Gibbons | A41D 3/08 |
| 2018/0228301 | A1 * | 8/2018 | Winfield Kmiec | B62B 3/1436 |
| 2019/0150525 | A1 * | 5/2019 | Arshava | A41C 3/0064 |

* cited by examiner

ADJUSTABLE BREAST SUPPORT GARMENT

This application claims priority from and the benefit of the filing date of U.S. Provisional Patent Application No. 62/818,721, filed Mar. 14, 2019, and the entire content of such application is incorporated herein by reference.

FIELD

This invention relates to breast support garments and more particularly it relates to adjustable breast support garments to adjust the size and the fit of such breast support garments.

BACKGROUND

Typically, breast support garments known in the prior art have some adjustment means in order to make slight adjustments to the size and/or the fit of the garment. For example, traditional bras generally comprise a strap adjustment arrangement to adjust the length of the straps. Normally, each of the straps in typical bras comprises a separate adjusting system. In addition, the underband of known bras can also comprise an adjustment system to adjust the torso opening to fit wearers having the same bra size but slightly larger or smaller torso (chest) sizes. In order to adjust the garment, the wearer of such known breast support garments needs to individually adjust each of such adjustment systems (i.e., adjust each strap and the underband separately). In addition, in most typical bras, the band and strap adjustments are at the back of the bra making the adjustment even more difficult especially while the garment is worn and the wearer needs to reach to the back to make such adjustment.

Further, different physical activities require different levels of breast support. For example, running or jumping may require a high level of breast support compared to activities such as walking, meditating or yoga that may require a lower level of breast support. Typical athletic or sports bras are designed to restrict the movement of breast tissue by uniformly compressing the breast tissue to the wearer's chest and such compression can be uncomfortable for the wearer because it does not effectively distribute the pressure around the wearer's torso.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure. Sizes and relative positions of elements in the drawings are not necessarily drawn to scale. For example, the shapes of various elements and angles may be not drawn to scale, and some of these elements may be arbitrarily enlarged and positioned to improve drawing legibility.

DETAILED DESCRIPTION

The present invention provides an adjustable breast support garment that can adjust the size and the amount of breast support to a preferred fit and sensation (more support or less) from a single point using a single tensioning system that is easily reachable by the wearer. The adjustable breast support garment of the present invention is configured to adjust the tension over the shoulders, around the chest, and in some implementations around the under arm opening or around the neckline from a single point using a system of channels integrated into the garment. Elastic straps, webbings, shock cords or any combination thereof can be inserted and run through the system of channels in order to provide a tension change when pulled from a single point. The adjustable breast support garment can be a brasserie, a swimwear, a tank top, a body suit or any other garment where breast support may be required.

Reference will now be made in detail to embodiments of the invention, examples of which are illustrated in the accompanying drawings. While the invention is described in conjunction with these embodiments, it will be understood that the descriptions herein are not intended to limit the scope of the invention to these embodiments. On the contrary, the invention is intended to cover alternatives, modifications, and equivalents that may be included within the spirit and scope of the invention as defined by the appended claims. Detailed description of components that are well known in the art may be omitted if that detailed description would confuse or obscure the description of the embodiments of the present invention.

Figure 1:
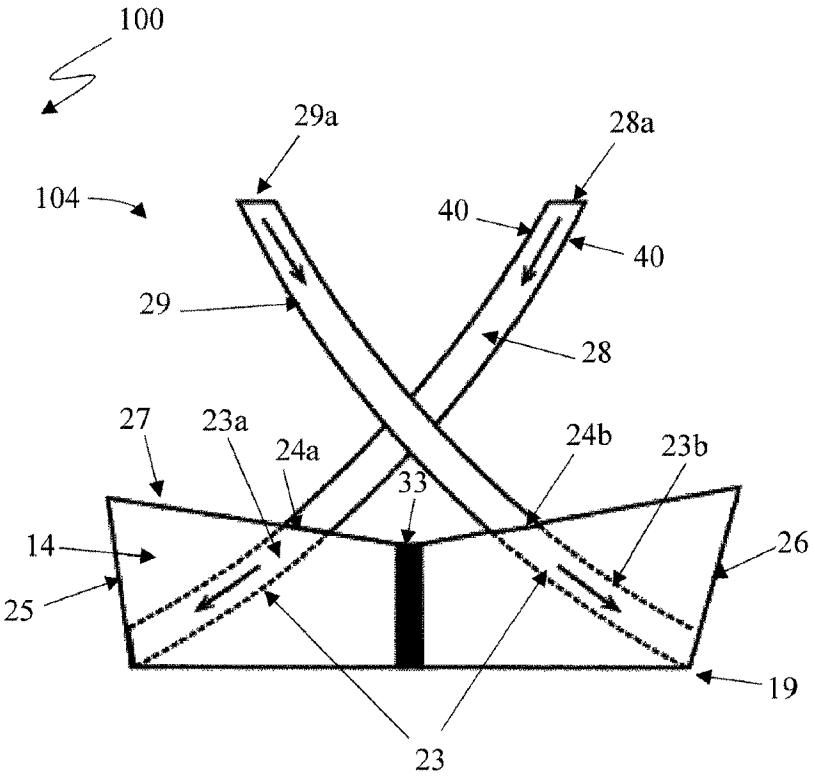
FIG. 1 is a partial front view (view on the left) and a rear view (view on the right) of an example of an adjustable breast support garment showing an example of a single point adjustment system.
Figure 1:
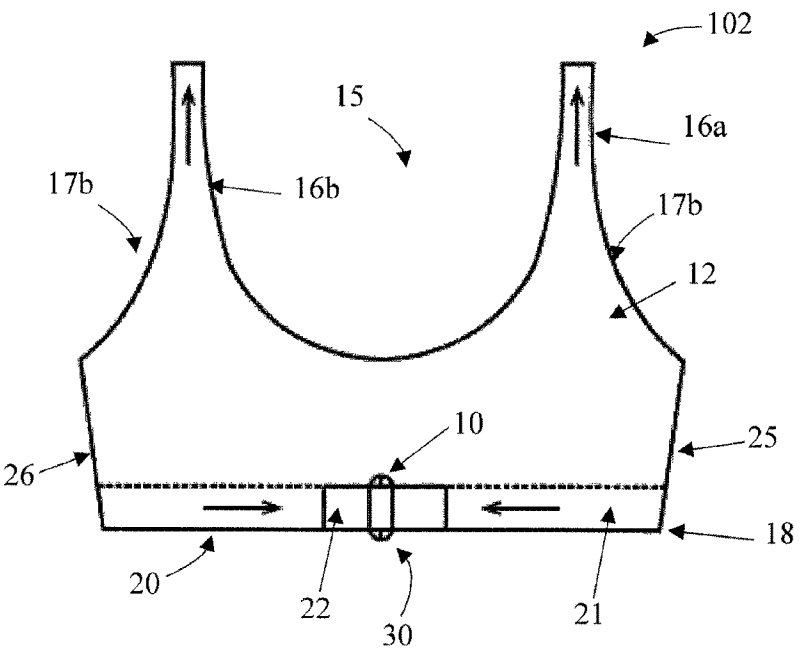

FIG. 1 illustrates an example of an adjustable breast support garment 100 that includes a front structure 102 (view on the left) and a back structure 104 (view on the right). The front structure 102 comprises a front panel 12 that covers at least a portion of a wearer's chest and its shaped to form a pair of front straps 16*a* and 16*b*, a neck opening 15, and two arm openings 17*a*, 17*b*. The back structure 104 can comprise at least one back panel 14 that is connected to respective side edges of the front panel 12 forming a torso opening. In one implementation, the back panel 14 can comprise two wings (left and right wing) connected to the respective side edges of the front panel 12. In one implementation, the wings can be detachably connected to one another at their free ends using any known connecting means, such as a hook & loop system. The front panel 12, the back panel 14, and front straps 16*a*, 16*b* may be made from or include a material or fabric such as nylon with Lycra (e.g., Ultralu™, etc.) or any other suitable material or fabric. In one implementation, the front panel 12 and/or the back panel 14 can be laminated including at least an outer layer and an inner layer. The front panel 12 can have a flat panel design to provide breast support or it can be molded to form two breast cups sized to encapsulate and support the wearer's breasts.

A system of channels 20 is integrated into the garment 100 such that an elastic strap can slide therein. The system of channels 20 can comprise an under-breast channel 21 that extends from one side of the front panel 12 to the opposite side in the under breast region and a back channel 23 that is integrated with the back panel 14 and is continuous with the under-breast channel 21. For example, the front under-breast channel 21 may extend from a left side 25 of the garment 100 to the right side 26 and may be positioned under the breast tissue for breast support. The left and right side edges 25, 26 are the side edges between the front and the back panels 12, 14. In one example embodiment, the under-breast channel 21 can be formed by folding a lower edge 18 of the front panel 12 and affixing it by, for example, sewing, bonding, gluing, etc., to the inner side of the front panel 12. The back channel 23 can comprise a left back channel 23*a* that traverses curving from the left side edge 25 to an upper edge 27 of the back panel 14, and a right back channel 23*b* that traverses curving from the right side edge 26 to the upper edge 27. The system of channels 20 further comprises two openings, such as for example an opening 24*a* formed at the end of the left back channel 23*a* and an opening 24*b* formed at the end of the right back channel 23*b*. The openings 24*a* and 24*b* are spaced apart, such that opening 24*a* is positioned left and away of a back panel mid-line 33 and the opening 24*b* is positioned right and away of the mid-line 33. The front under-breast channel 21 can further comprise a front opening 22 that is formed at a face of the under-breast channel 21 and which can be positioned and sized so that the wearer can easily reach it. In one implementation, the back channel 23 can be omitted and the openings 24*a*, 24*b* can be formed at the right and left ends of the under-breast channel 21 (e.g., at the right and left side edges 26, 25).

The garment 100 can further comprise a first elastic strap 28 with a connection end 28*a* attached to a top edge of one of the front straps 16*a*, 16*b* and a free end; and a second elastic strap 29 with a connection end 29*a* attached to a top edge of the other of the front straps 16*a*, 16*b* and a free end. Each of the first and the second elastic straps 28, 29 is connected to a respective top edge of one of the front straps 16*a*, 16*b*. At the back of the garment 100, the first and second elastic straps 28, 29 crisscross one on top of the other. The free end of each of the elastic straps 28, 29 is inserted through a respective opening 24*a*, 24*b* into the respective back channels 23*a*, 23*b* and the under-breast channel 21 such that the free end of each of the elastic straps 28, 29 exits at the front opening 22 from a respective left or right side of the garment 100. In the example illustrated in FIG. 1, the first elastic strap 28 enters through the opening 24*a* into the left back-channel 23*a* and passes through the left side 25 into the under-breast channel 21 and exits at the front opening 22, while the free end of the second elastic strap 29 enters through the right opening 24*b* into the right back-channel 23*b* and passes through the right side 26 into the under-breast channel 21 and exits at the front opening 22. The first and second elastic straps 28, 29 can be designed and sized such that they can easily slide within the system of channels 20 (i.e., channels 23 and 21). In addition, the width 40 of the elastic straps 28, 29 is selected so that it can provide a sufficient under-breast support.

Figure 7:
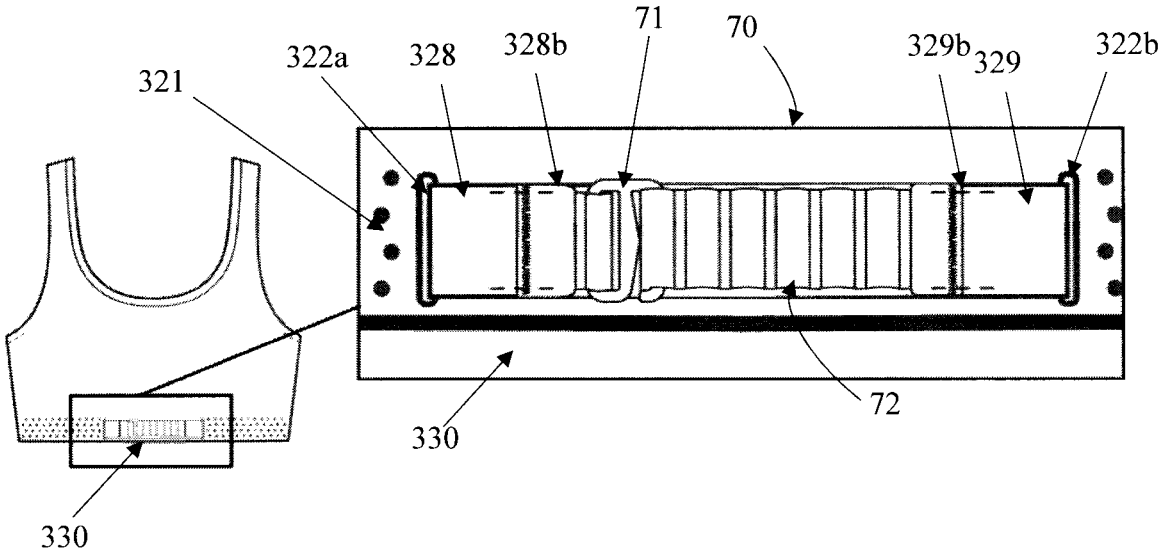
FIG. 7 is a front detail view of an example embodiment of a single point adjustment system.

The free ends of the elastic straps 28, 29 are connected to a tensioning system 30 that is configured to adjust the size and the support level of the garment 100 by tensioning or releasing the elastics straps 28, 29. The tensioning system 30, for example, can comprise a fastening element such as a buckle 10 that is connected to the free end of one of the elastic straps 28, 29 while the free end of the other elastic strap can be inserted into the buckle 10. Any other known tensioning system 30 can be used without departing from the scope of the invention. For example, FIG. 7 illustrates another example of a tensioning system 70 that comprises a hook 71 attached at the free end of one of the elastic straps 28, 29 and a system of loops 72 formed at the free end of the other elastic strap 28, 29, such that by engaging the hook 71 to the loops 72 the wearer can change the size and support sensation of the breast support garment 100. As illustrated by the arrows in FIG. 1, in order to increase the tension, the wearer can pull the free end of one of the elastic straps 28, 29 into the buckle 10 and tighten it, so that a force is applied to the elastic straps 28, 29 pulling them so that the straps 28, 29 slide in the respective channels 21, 23*a*, 23*b*. This will result in a slight change in the size of the torso opening (making the garment 100 tighter around the torso), increasing the pressure applied in the under-breast channel 21 (under the breast tissue) and pulling up the top edges of the front straps 16*a*, 16*b* over the shoulders, increasing the pressure and support provided by the front panel 12 (compressing the breast tissue closer to the wearer's body). In order to release tension and make the garment 100 feel looser, the wearer can simply reach to the front opening 22, loosen the elastic strap engaging the buckle 10 thus loosening the tension in the straps 28, 29 and reducing the pressure/stretch in the elastic straps 28, 29 which will reduce the pressure applied by the straps 28, 29 in the under-breast channel 21 and on the front straps 16*a*, 16*b*. The tensioning system 30 can be any other known tensioning system such as rigid pegs and holes, Velcro strips formed at the free ends of the straps 28, 29, or any other suitable tensioning system.

The curve of the left and right back channels 23*a*, 23*b* is designed to allow the straps 28, 29 to slide easily within the back channels 23*a*, 23*b* as well as the front under-breast channel 21 with reduced or without any twisting or bulging. In one implementation, the surface of the straps 28, 29 or the inner surface of the channels 21, 23 can be treated to allow easier sliding of the straps 28, 29 in the channels 21, 23. For example, the elastic straps 28, 29 can be made of a material that contains a pre-determined amount of silicon, so that the straps 28, 29 are smoother/softer and can slide much easier. The embodiment of the adjustable breast support garment 100 illustrated in FIG. 1 provides two-way adjustability, such as adjusting the size and pressure around the torso opening/under-breast channel 21 and the pressure applied by the front and back (shoulder) straps 16, 28, 29.

Only parts of the straps 28, 29 can slide within the channels 21, 23 while other parts of the straps 28, 29 can be uncovered. For example, the part of the straps 28, 29 that passes over the shoulder and across the back of the wearer are not inserted into the channels 23*a*, 23*b*. In an implementation where the back channel 23 is omitted, a number of loops can be provided on the back panel 14 to guide/curve the straps 28, 29 across the back.

Figure 2:
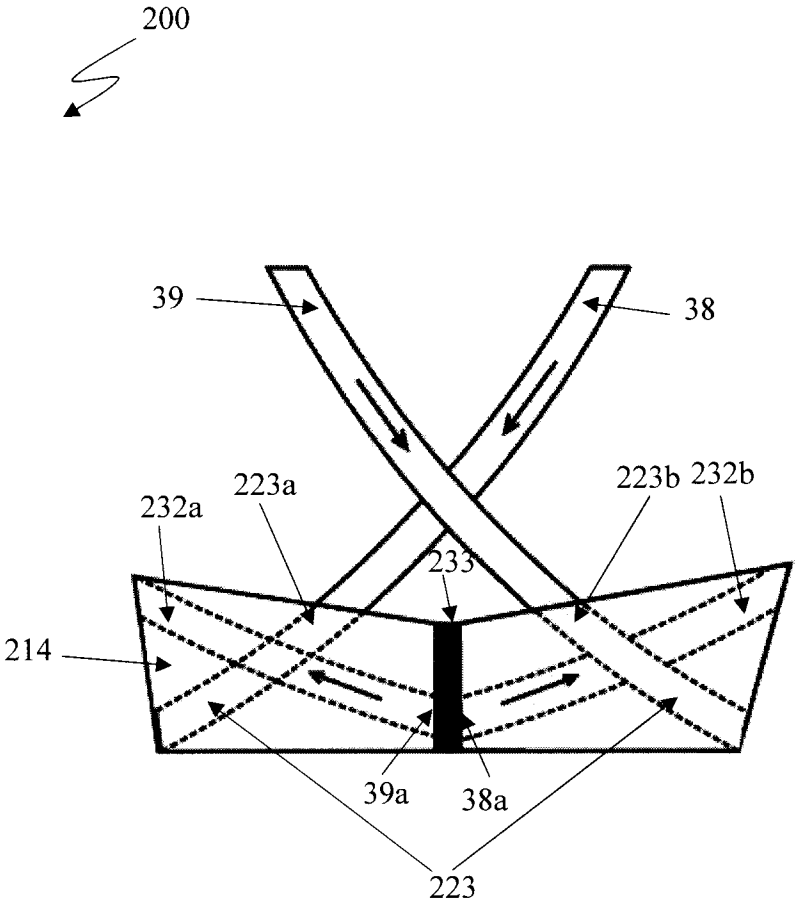
FIG. 2 is a partial front view (view on the left) and a rear view (view on the right) of an example of an adjustable breast support garment showing another example of a single point adjustment system.
Figure 2:
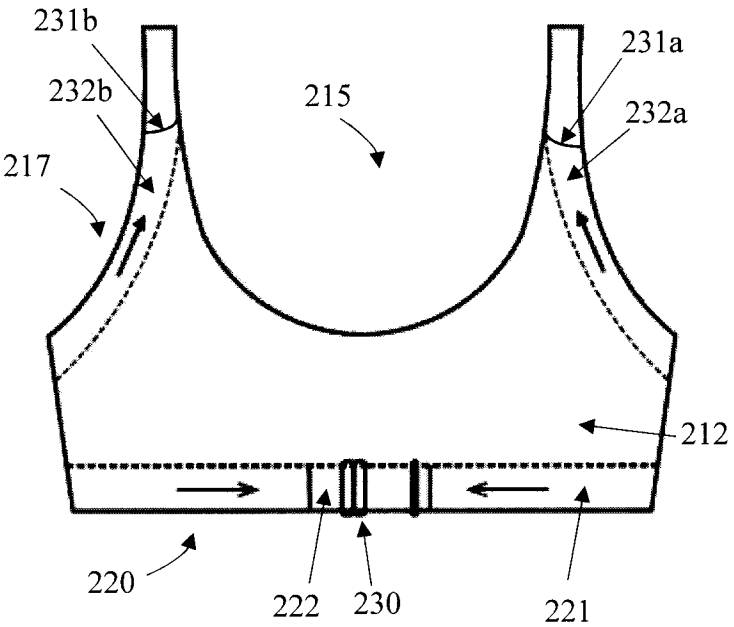

FIG. 2 illustrates another example of an adjustable breast support garment 200 that can provide three-way adjustability. Similar to garment 100, the garment 200 also comprises a system of channels 220 integrated into the garment 200 with an under-breast channel 221, a back channel 223 having left and right back channels 223*a*, 223*b*, and two underarm channels, such as a left underarm channel 232*a* and a right underarm channel 232*b*. The left and right underarm channels 232*a*, 232*b* can extend in a back panel 214 and can end at a back panel mid-element 233. The back panel mid-element 233 can be a closing element for fastening the left and the right wings of the back panel 214 or it can simply be a mid-piece of the back panel 214 where the channels 232*a*, 232*b* end. Thus, the channels 232*a*, 232*b* are not in communication and are separated by the mid-element 233. Each of the left and the right underarm channels 232*a*, 232*b* can have an opening 231*a*, 231*b* formed on the front panel 212 on each side of the neck opening 215.

The garment 200 further comprises a first elastic strap 38 with a connection end 38*a* that is connected to the back mid-element 233 and a second elastic strap 39 with a connection end 39*a* also connected to the back mid-element 233. The free end of each of the elastic straps 38, 39 slides through the respective channels 232*a*, 232*b* traversing across the back panel 214, around the under arm openings 217*a*, 217*b* and exit through the respective openings 231*a*, 231*b*, then extends over a respective shoulder of the wearer into the respective back channels 223*a*, 223*b* and the under-breast channel 221 to the front opening 222. Each of the free end of the straps 38, 39 is connected to the tensioning system 230 that can be same as the tensioning system described with respect to the garment 100 of FIG. 1. As illustrated by the arrows in FIG. 2, in order to increase the tension, the wearer can pull the free ends of the elastic straps 38, 39 so that a force is applied to the elastic straps 38, 39. The stretch of the straps 38, 39 increases as they slide in the under-breast channel 221, the respective back channels 223*a*, 223*b*, and under-arm channels 232*a*, 232*b*. This will result in a change in the size of the torso opening (making the garment tighter around the torso), increasing the pressure applied in the under-breast channel 221 (under the breast tissue), and a size of the under-arm openings 217*a*, 217*b*, and will increase the pressure and support provided by the front panel 212 (compressing the breast tissue closer to the wearer's body). In order to release the tension and make the garment 200 feels looser, the wearer can simply reach to the front opening 222 and release the tensioning system 230, loosening the tension in the straps 38, 39 and reducing the pressure provided by the garment 200.

In one implementation, the channels 232*a* and 232*b* can be continuous across the back of the garment 200 and only one elastic strap can be used having two free-ends. This means that the channels 232*a* and 232*b* can be joined at the back mid-element 233 and the mid-element 233 may be omitted. For example, one of the free ends of the single elastic strap can be inserted into the under-breast channel 221 and can extend through one of the back channels (e.g., back channel 223*a*) over the shoulder into the under-arm channel 232*b* through the opening 231*b*, traverse across the back panel 214 continuing into the under-arm channel 232*a* over the other shoulder and into the back channel 223*b* and the under-breast channel 221 to the front opening 222 to face the other free end of the elastic strap. Persons skilled in the art would understand that the openings 231*a*, 231*b* at the front of the garment 200 or the openings 24*a*, 24*b* at the back of the garment can be omitted and the system of channels 20, 220 can continue from the front structure 12, 212 of the breast support garment 100, 200 over the shoulders of the wearer into the back structure 14, 214 of such garment without departing from the scope of the invention.

Figure 3:
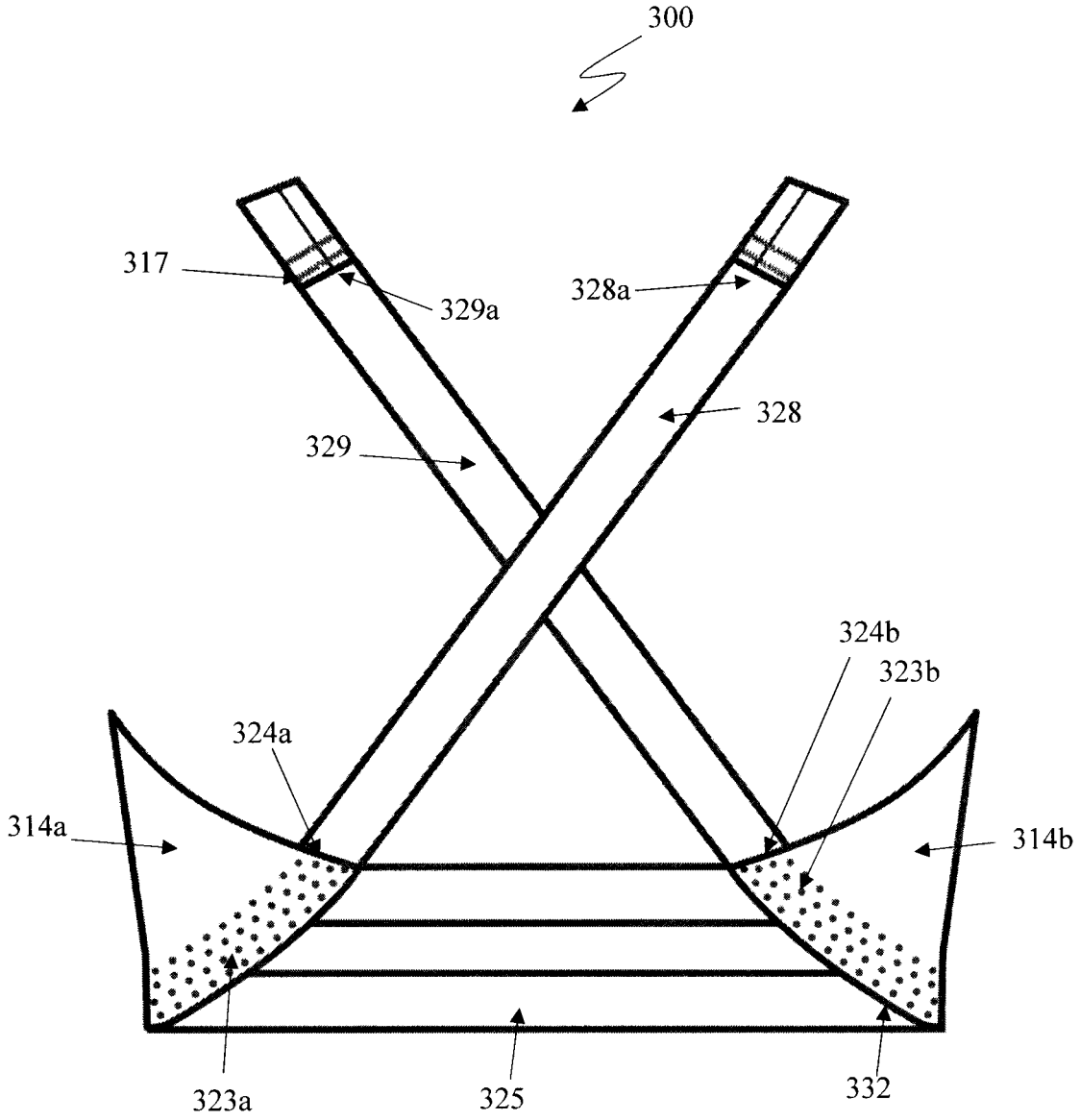
FIG. 3 is a partial rear outside view of an example embodiment of an adjustable breast support garment.
Figure 4:
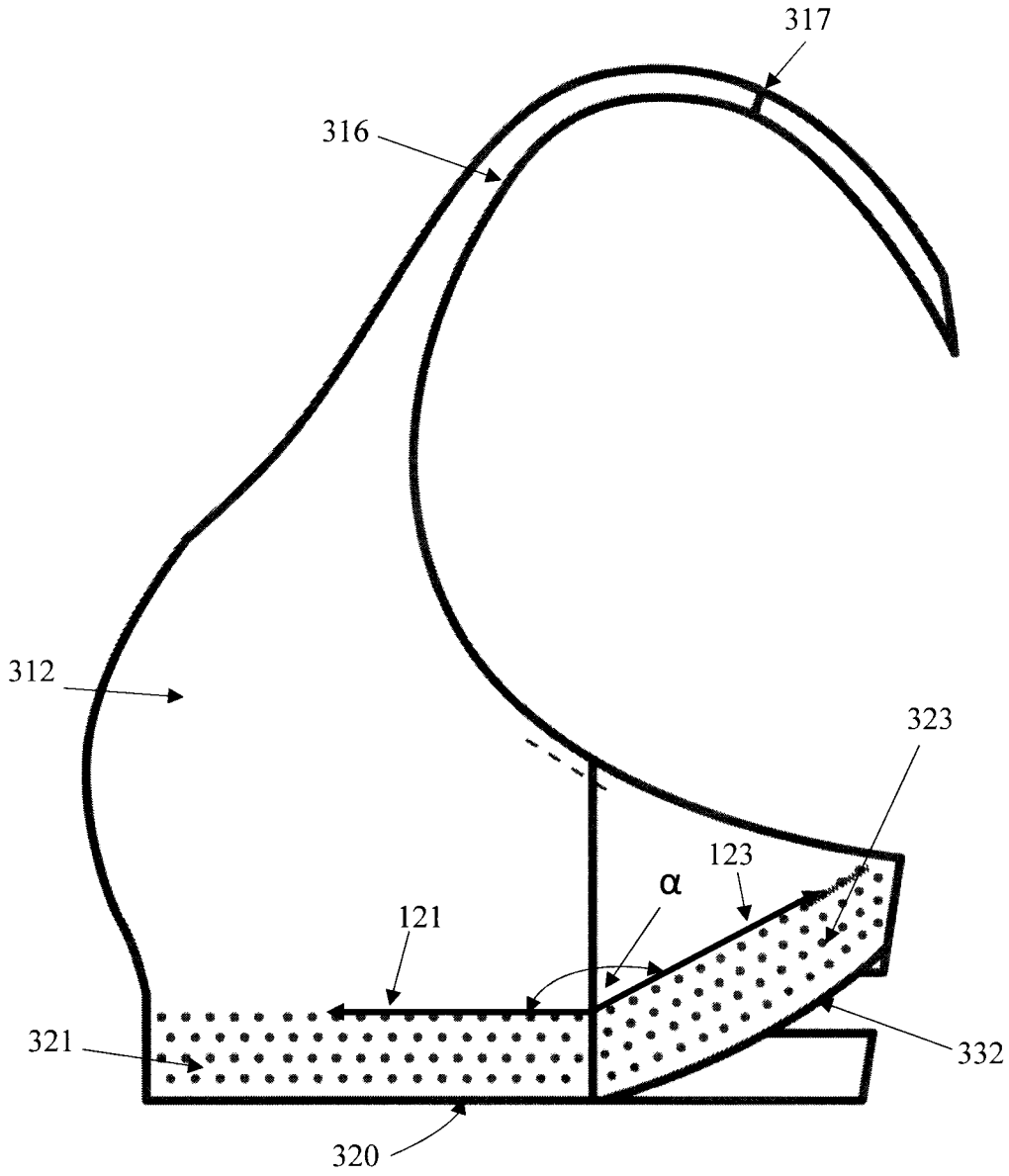
FIG. 4 is a partial side outside view of an example embodiment of an adjustable breast support garment.
Figure 5:
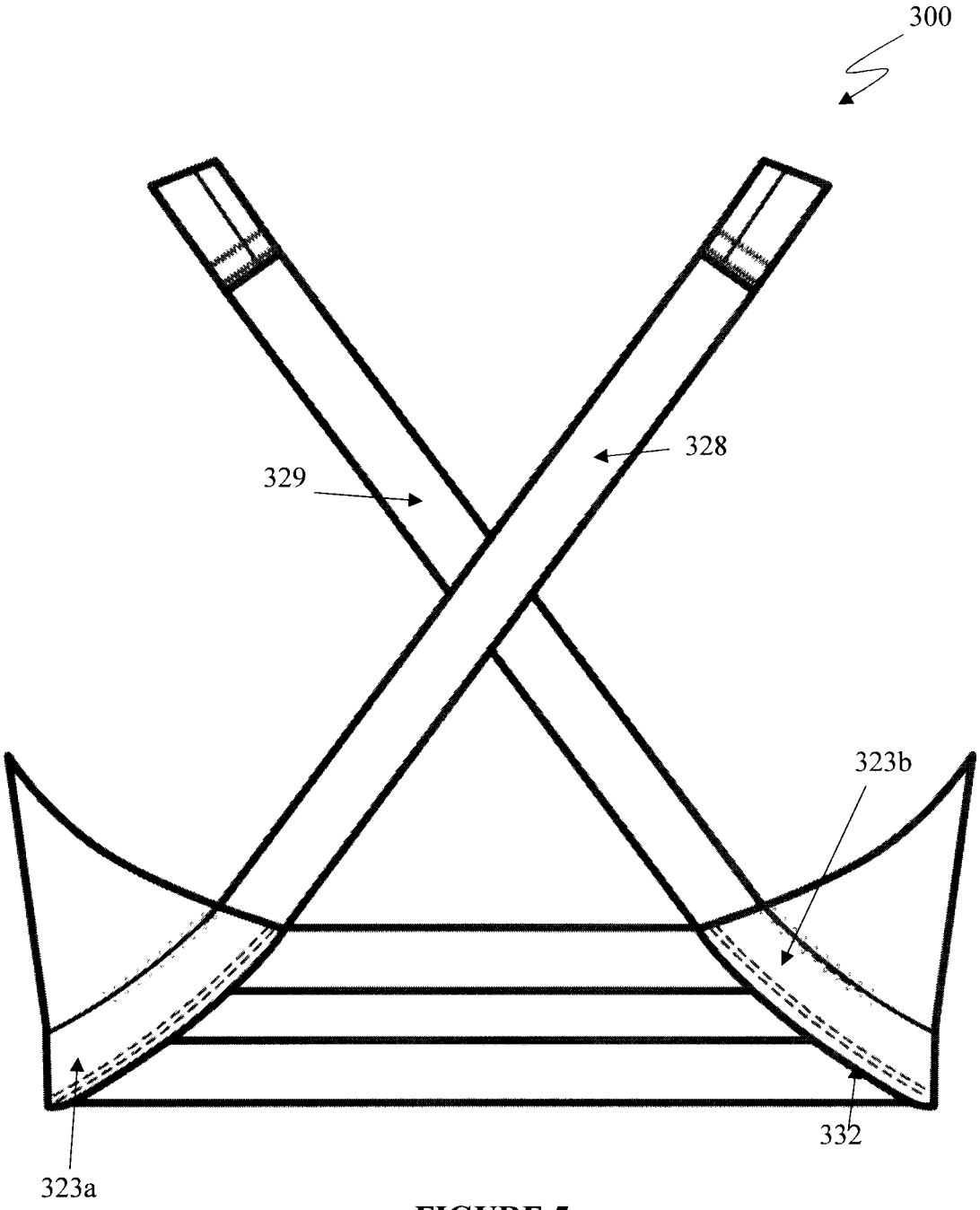
FIG. 5 is a partial rear inside view of an example embodiment of the adjustable breast support garment of FIG. 3.
Figure 6:
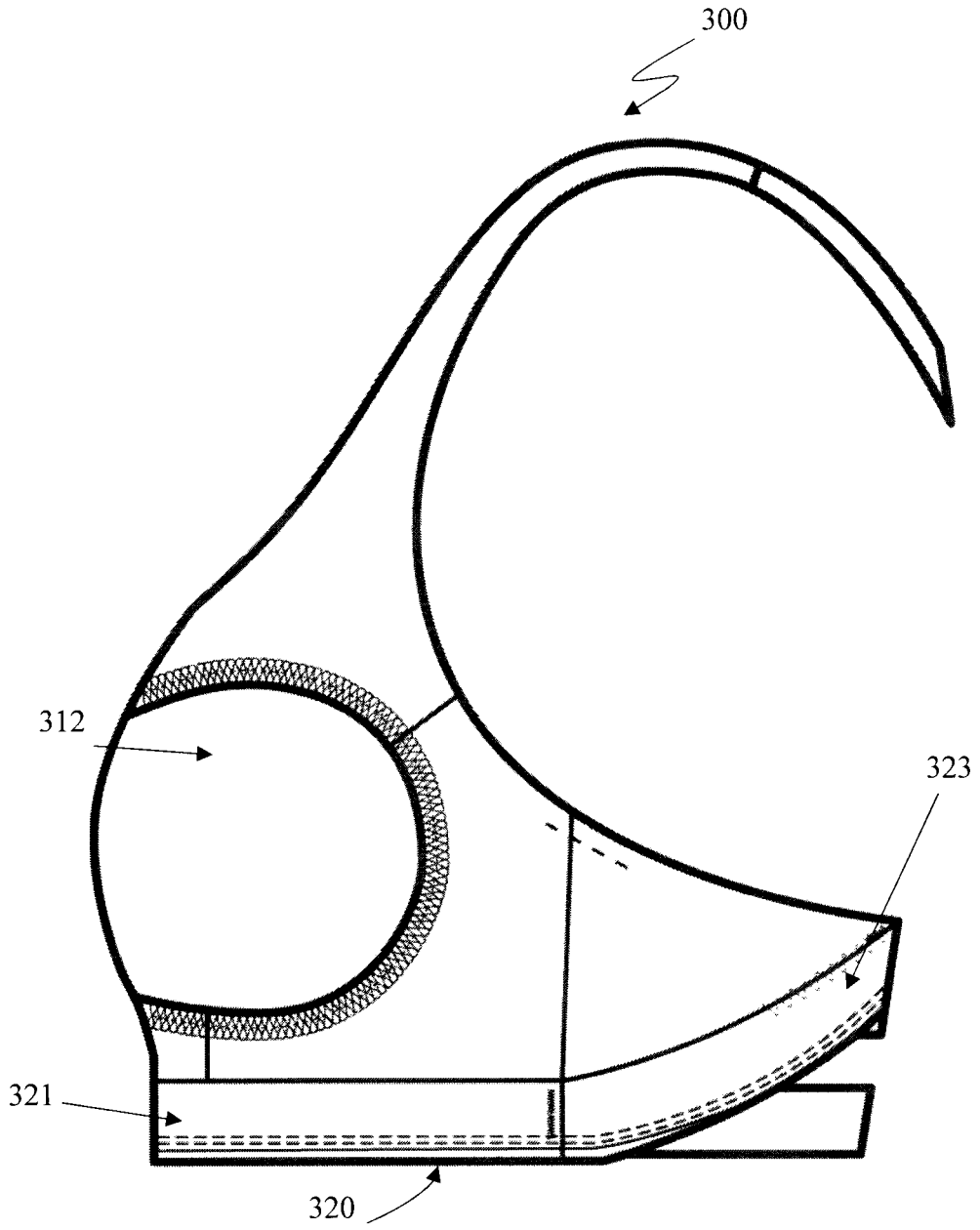
FIG. 6 is a partial side inside view of an example embodiment of the adjustable breast support garment of FIG. 4.

FIGS. 3 and 4 illustrate another example of an adjustable breast support garment 300 showing the outside of the garment 300 while FIGS. 5 and 6 illustrate the inside of the garment 300 when the garment 300 is turned inside-out. The garment 300 comprises a front panel 312 with a pair of shoulder straps 316 and two back wings 314*a*, 314*b* affixed to a respective side edge of the front panel 312. A system of channels 320 is integrated into the garment 300 such that they continuously extend under the breast area of the front panel, e.g., an under-breast channel 321, and along a portion of each back wing 314*a*, 314*b* forming back channels 323*a*, 323*b*. A pair of elastic straps 328, 329 are affixed to respective ends 317 of the shoulder straps 316. A free end of each of the elastic strap 328, 329 is inserted into the continuous system of channels 320 through a respective back channel opening 324*a*, 324*b*, such that one of the straps passes through the left back channel 323*a* and left side of the garment 300 into the under-breast channel 321 while the other strap is inserted into the right back channel 323*b* and passes through the right side of the garment 300 into the under-breast channel 321. Each of the free-ends of the straps 328, 329 exits the under-breast channel through a front exit opening which can be the same as the front opening 22, 222 of FIGS. 1 and 2. In one implementation, there can be two front exit openings, such that each of the straps can exit the under-breast channel 321 through a separate exit opening. The free-ends of each elastic strap 328, 329 are connected to a tensioning system 330 (see FIG. 7) used to adjust the size and fit of the garment 300 as described herein above with respect to garments 100 and 200. The garment 300 can further comprise one or two back straps 325 extending and connected to each of the back wings 314*a*, 314*b*. In order to avoid any twisting and/or bulging of the elastic straps 328, 329 during tensioning and releasing action, it is important that the width of the straps 328, 329 is smaller than the width of the channel 320. A curve 332 of the back channels 323 at the back of the garment 300 is designed to allow for easy sliding within the channels 321, 323. For example, the slope of the curve 332 can be defined by an angle $\alpha$ between the back channel 323 and the under-breast channel 321. The angle $\alpha$ is the angle between a direction vector 123 of the back channels 323 and a direction vector 121 of a under-breast channel 321 and such angle can range between 125 to 145 degrees (depending on the width of the elastic straps 328, 329) in order to prevent or reduce any twisting of the elastic straps 328, 329 during tensioning/releasing action. In one implementation, the angle $\alpha$ can be 136 degrees or approximately 136 degrees. In one implementation, the inner surface of the system of channels 320 and/or the outer surface of the elastic straps 328, 329 can be treated to lower the friction between the straps 328, 329 and the channel fabric during sliding (tensioning/releasing) action.

Figure 8:
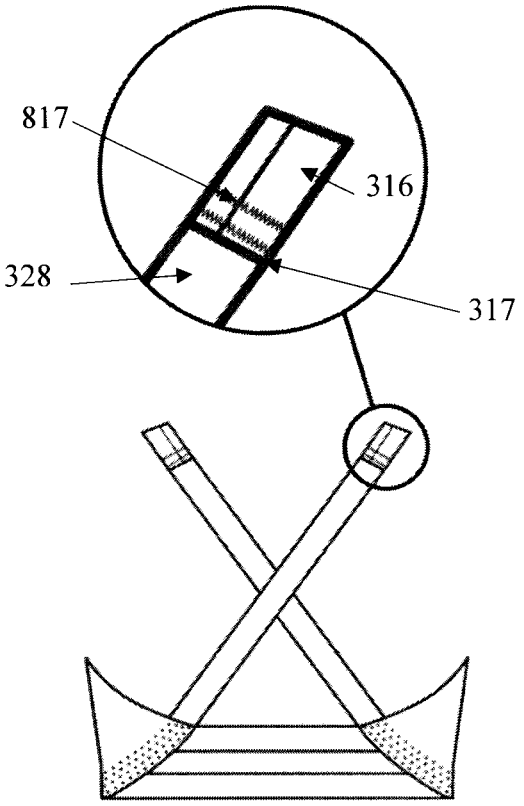
FIG. 8 is a rear detail view of an example embodiment of an adjustable breast support garment showing an example of an elastic band attached to a front strap.

The connection end 328*a*, 329*a* of the elastic straps can be sandwiched between an inner and an outer layer of the shoulder strap 316 at the end 317 and secured by sewing (e.g., using respective lengthwise bartacks 817 as illustrated in FIG. 8). In one implementation, the elastic straps 328, 329 can be attached to the shoulder straps 316 by gluing or using any other stiches or fastening means, as long as the straps 328, 329 stay secured to the shoulder straps 316 when tension is applied which stretches the elastic straps 328, 329 and pulls up the shoulder straps 316.

FIG. 7 shows in detail one example embodiment of the tensioning system 70 used for adjusting the size, fit and pressure of the breast support garment, e.g., the breast support garment 300. As illustrated in FIG. 7, the free-end of one of the elastic straps (e.g. the free-end 328*b* of the strap 328) can exit the under-breast channel 321 at a first front opening 322*a*. The rigid hook 71 from the tensioning system 70 is secured at the free end 328*b* of the elastic strap 328. The free-end 329*b* of the other elastic straps 329 can exit the under-breast channel 321 at a second front opening 322*b*. The loop trim 72 from the tensioning system 70 is secured at the free end 329*b* of the elastic strap 329. A wearer can put on the garment 300 and can adjust such garment to their size and preferred sensation by adjusting the tension in garment components, such as strap tension, underband tension and in some embodiments armhole tension, from a single point in the front of the garment. For example, to tighten the garment 300, the wearer can pull the elastic straps 328, 329 closer such that the hook 71 engages a loop 72 that is closer to the free-end 329*b* increasing the stretch/tension in the straps 328, 329. To loosen the pressure/support provided by the garment 300 and slightly increase the fit size, the wearer can simply unhook the hook 71 and then engage a loop 72 that is further away from the free-end 329*b*.

While particular elements, embodiments and applications of the present disclosure have been shown and described, it will be understood, that the scope of the disclosure is not limited thereto, since modifications can be made by those skilled in the art without departing from the scope of the present disclosure, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and subcombinations are intended to fall within the scope of this disclosure. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the inventions described herein.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example calculations, simulations, results, graphs, values, and parameters of the embodiments described herein are intended to illustrate and not to limit the disclosed embodiments. Other embodiments can be configured and/or operated differently than the illustrative examples described herein.

What is claimed is:

1. A single point adjustable breast support garment comprising:

a front panel for covering at least a portion of a wearer's chest, the front panel having a pair of shoulder straps defining a neck opening;

a back panel for covering at least a portion of a wearer's back and attached to respective sides of the front panel to form a torso opening;

a system of channels integrated into a portion of the front panel and a portion of the back panel, the system of channels comprising an under-breast channel extending in an under breast region of the front panel from a left side of the front panel to a right side thereof, and a back channel comprising a left back channel curving up from the left side of the front panel and a right back channel curving up from the right side of the front panel;

a front opening formed in a face of the under-breast channel;

a first elastic strap for passing over the wearer's shoulder and having a connection end connected to the garment and a free end, the free end of the first elastic strap passing through one of the back channels and the under-breast channel and exiting at the front opening;

a second elastic strap for passing over the wearer's shoulder and having a connection end connected to the garment and a free end, the free end of the second elastic strap passing through the other of the back channels and the under-breast channel and exiting at the front opening such that the free end of the second elastic strap faces the free-end of the first elastic strap; and a tensioning system having a fastening element connected to the free end of one of the elastic straps, the free end of the other elastic strap configured to engage the fastening element to adjust a tension in the elastic straps, wherein a width of each channel of the system of channels is greater than a width of each of the first and second elastic straps and wherein the width of each of the first and second elastic straps is configured to provide breast support in the under-breast region.

2. The breast support garment according to claim 1, wherein a curve of the left and right back channels is defined by an angle between a direction vector of the right and left back channels with respect to a direction vector of the under-breast channel, the angle being in a range of 130 to 140 degrees in order to prevent or reduce any twisting of the elastic straps during tensioning/releasing action.

3. The breast support garment according to claim 2, wherein the angle is 136 degrees or approximately 136 degrees.

4. The breast support garment according to claim 1, wherein the back channel is one or more loops formed in the back panel to guide a curve of the first and second elastic straps across the back of the wearer.

5. The breast support garment according to claim 1, wherein an outer surface of each of the elastic straps is treated with an anti-friction material to lower friction between the elastic straps and an inner surface of each channel of the system of channels.

6. The breast support garment according to claim 5, wherein the elastic straps are made of a material comprising a pre-determined amount of silicon.

7. The breast support garment according to claim 1, wherein the fastening element is a buckle.

8. The breast support garment according to claim 1, wherein the fastening element is a hook and further comprising one or more loops formed at the free end of the other elastic strap.

9. The breast support garment according to claim 1, wherein the connection end of the first elastic strap is connected to the garment at an upper end of one of the pair of shoulder straps and wherein the connection end of the second elastic strap is connected to the garment at an upper end of the other of the pair of shoulder straps.

10. The breast support garment according to claim 1, wherein the system of channels further comprises two under-arm channels that extend from respective shoulder straps along respective under-arm openings and traverse across at least a portion of the back panel; wherein the connection end of the first elastic strap is connected to the garment at a mid-element formed in the back panel, the connection end of the first elastic strap passing through one of the under-arm channels; and, wherein the connection end of the second elastic strap is connected to the garment at the mid-element formed in the back panel, the connection end of the second elastic strap passing through the other of the under-arm channels.

11. A single point adjustable breast support garment comprising:

a front panel for covering at least a portion of a wearer's chest, the front panel having a pair of shoulder straps;

a back panel for covering at least a portion of a wearer's back and attached to respective sides of the front panel to form a torso opening, a neck opening, and two under-arm openings;

a system of channels integrated into a portion of the front panel and a portion of the back panel, the system of channels comprising an under-breast channel extending in an under breast region of the front panel from a left side of the front panel to a right side thereof, a back channel comprising a left back channel curving from the left side and traversing across the back panel and a right back channel curving from the right side and traversing across the back panel, and two under-arm channels that extend from respective shoulder straps along respective under-arm openings and traverse across at least a portion of the back panel;

a front opening formed in a face of the under-breast channel;

an elastic strap extending through the system of channels such that one free end of the elastic strap exits the under-breast channel at a left side of the front opening and the other free end of the elastic strap exits the under-breast channel at a right side of the front opening; and a tensioning system having a fastening element connected to at least one of the free ends of the elastic strap and the other free end of the elastic strap is configured to engage the fastening element to adjust a tension in the elastic strap, wherein a width of each channel of the system of channels is greater than a width of the elastic strap.

12. The breast support garment according to claim 11, wherein a curve of the left and right channels is defined by an angle between a direction vector of the right and left channels with respect to a direction vector of the under-breast channel, the angle being in a range of 130 to 140 degrees in order to prevent or reduce any twisting of the elastic straps during tensioning/releasing action.

13. The breast support garment according to claim 12, wherein the angle is 136 degrees or approximately 136 degrees.

14. The breast support garment according to claim 11, wherein an outer surface of the elastic strap is treated with an anti-friction material to lower friction between the elastic strap and an inner surface of each channel of the system of channels.

* * * * *